US008196329B1

(12) United States Patent
Mossie

(10) Patent No.: US 8,196,329 B1
(45) Date of Patent: Jun. 12, 2012

(54) WEAPON ACCESSORY MOUNTING SYSTEM

(76) Inventor: Bradley W. Mossie, Lomita, CA (US)

( * ) Notice: Subject to any disclaimer, the term of this patent is extended or adjusted under 35 U.S.C. 154(b) by 0 days.

(21) Appl. No.: 13/327,747

(22) Filed: Dec. 15, 2011

Related U.S. Application Data

(60) Provisional application No. 61/527,539, filed on Aug. 25, 2011, provisional application No. 61/538,093, filed on Sep. 22, 2011.

(51) Int. Cl.
*F41C 27/00* (2006.01)

(52) U.S. Cl. ..... 42/90; 248/245; 42/124; 42/127

(58) Field of Classification Search ..... 42/72, 90, 42/124, 125, 127; 248/222.14, 223.41, 224.61, 248/177.1, 187.1, 245, 229.17
See application file for complete search history.

(56) References Cited

U.S. PATENT DOCUMENTS

| | | | | |
|---|---|---|---|---|
| 4,845,871 | A * | 7/1989 | Swan | 42/127 |
| 5,107,612 | A * | 4/1992 | Bechtel | 42/115 |
| 5,198,600 | A * | 3/1993 | E'Nama | 42/90 |
| 5,595,011 | A * | 1/1997 | Gorslin | 42/112 |
| 6,393,752 | B1 * | 5/2002 | Oliver et al. | 42/114 |
| 6,536,153 | B2 * | 3/2003 | Lindsey | 42/85 |
| 6,775,942 | B2 | 8/2004 | Compton | |
| 6,779,288 | B1 | 8/2004 | Kim | |
| 6,854,206 | B2 | 2/2005 | Oz | |
| 7,240,451 | B2 * | 7/2007 | Blair | 42/124 |
| 7,954,273 | B1 * | 6/2011 | Swan | 42/115 |

OTHER PUBLICATIONS http://m-guns.com/tools.php, Feb. 19, 2006, accessed via www.archive.org.
http://m-guns.com/tools.php, Jul. 23, 2008, accessed via www.archive.org.
http://hahn-precision.com/Forward-Light-Mount-AFLMP0404.htm, Aug. 23, 2010, accessed via www.archive.org.

* cited by examiner

*Primary Examiner* — Gabriel Klein
(74) *Attorney, Agent, or Firm* — Lance M. Pritikin

(57) ABSTRACT

A weapon accessory mounting system for mounting an accessory, such as a light or laser sight, directly to the front sight base of a host weapon without requiring modification of the weapon. The system includes a bracket with a clamp member and a plank member. The clamp member has a generally C-shaped cross-section defined by a base portion disposed between two clamp arms. The C-shaped cross-section defines a channel extending along a sight base axis. The plank member has a rail portion for slidably mounting a weapon accessory, and at least one accessory engagement slot for latchable engagement by the accessory. The aim axis is generally perpendicular to the sight base axis. The system typically includes two detent elements disposed in the base portion for actuatable protrusion of a portion of the detent elements into the channel for providing a clamping force and adjustment of the rail pitch angle.

22 Claims, 8 Drawing Sheets

(Dimensions in inches)

MIL-STD-1913 (AR)

Accessory mounting rail profile

MIL-STD-1913 (AR)

Recoil groove

WEAPON ACCESSORY MOUNTING SYSTEM

RELATED APPLICATIONS

This application claims the benefit of U.S. Provisional Application No. 61/527,539, filed on Aug. 25, 2011, and U.S. Provisional Application No. 61/538,093, filed on Sep. 22, 2011, the contents of each of which are incorporated by this reference in their entirety for all purposes as if fully set forth herein.

TECHNICAL FIELD

The present invention relates generally to accessory mounting systems for hand-held weapons. More particularly, the invention relates to a system for mounting accessories such as lights and laser sights in the 12 o'clock position on hand-held weapons used commonly in law enforcement, security and military operations.

BACKGROUND

Tactical weapons such as the M16, M4 and AR15 are commonly relied on by law enforcement, security and military personnel. Depending on the operating environment, lighting, aiming and other such accessories may need to be conveniently and temporarily mounted to the weapon in order to maximize the operator's effectiveness.

Common conventional mounting rail systems often require the accessory to be mounted on the hand guard of the weapon, away from the forward 12 o'clock position. This is often done in order to avoid interfering with the sight picture through the front sight of the weapon. Mounting of an accessory in the 12 o'clock position is preferable in that it allows the weapon operator to lead around obstacles with the respective light, laser or other accessory, affording the weapon operator improved cover and reduced exposure to hostile fire. Positioning a light in the forward 12 o'clock position also greatly increases the contrast between the sights (dark) and the target (bright) when the light is used. A light placed in the 12 o'clock position does not cast shadows on the side of the front sight, which would otherwise cause distortion of the sight picture. Furthermore, a light accessory placed in the 12 o'clock position aids in the use of the modern forward support hand rifle/carbine firing grip.

Alternative mounting systems exist in the prior art which frequently require the addition of structural features which may add significant weight or bulk, thereby interfering with the operation of the weapon. Other alternatives exist which require the accessory mount to be attached directly to the barrel of the weapon, thereby allowing heat to more easily transfer from barrel through the mount and to the accessory, and allowing the mass of the mount and accessory to interfere with the harmonics of the barrel. Still other existing solutions require a permanent modification to be made to the host weapon, such as tapping one or more holes to accommodate threaded fasteners and the like. However, making such permanent modifications to particular host weapons is frequently prohibited, and may thereby preclude the adoption and use of such systems.

What is needed is a lightweight, unobstructive, inexpensive, rapidly deployable and removable weapon accessory mounting system for temporarily mounting an accessory on a host weapon in the forward 12 o'clock position, while minimizing interference with the weapon's barrel harmonics, shielding the accessory from barrel heat, and requiring no modification of the host weapon. Also desirable in such a system would be the ability to adjust the pitch angle of the mounting rail to correct for variances in the design and manufacturing of the respective host weapon.

SUMMARY

Certain deficiencies of the prior art may be overcome by the provision of a weapon accessory mounting system for releasably mounting an accessory directly onto the front sight base of a host weapon without requiring permanent modification of the weapon. The mounting system may comprise a bracket including a clamp member and a plank member. The clamp member may have a generally C-shaped cross-section defined by a base portion disposed between two laterally opposed clamp arms each having an inner groove. The generally C-shaped cross-section may at least partially define a channel extending along a sight base axis. The plank member may extend outwardly from the base portion along an aim axis. The plank member may have a rail portion including two laterally disposed rail edges and at least one accessory engagement slot extending laterally therebetween. The aim axis is approximately perpendicular to the sight base axis. The system typically includes at least one detent element disposed in the base portion for actuatable protrusion of at least a portion of the detent element into the channel.

The system provides a pitch-adjustable bracket with a rail portion for slidably mounting conventional weapon accessories, such as lights and laser sights, to an existing host weapon in the 12 o'clock position. In addition, particular host weapons, such as those capable of employing the mounting system described and claimed herein, feature free-floating barrels. Free-floating the barrel of a weapon is known to improve its accuracy. A system in accordance with the present invention does not directly contact the barrel of the host weapon. As a result, the system's design minimizes the accessory's effect on the barrel harmonics of a free floated barrel.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
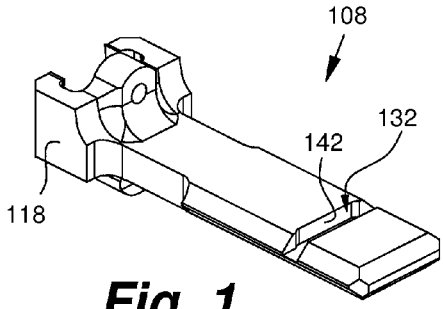
FIG. 1 is a diagrammatic perspective view of an example of a bracket element in accordance with the present invention.

Referring now to the drawings, like reference numerals designate identical or corresponding features throughout the several views. Shown generally at 100 are one or more embodiments of a weapon accessory mounting system for releasably mounting an accessory element 102 onto the front sight base 104 of a host weapon 106 without requiring permanent modification of the host weapon. The system may comprise a bracket element 108 and at least one detent element (as shown, for example, at 134). Example of such a host weapon 106 may include, for example, the M16A1, M16A2, M4, M4A1 and AR15.

Figure 2:
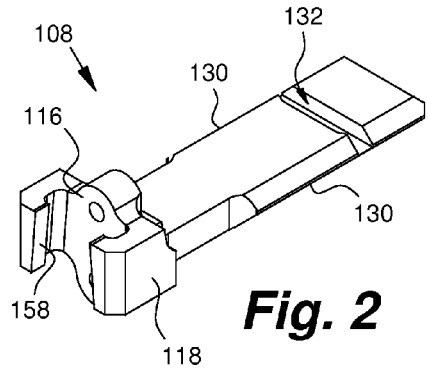
FIG. 2 is a further diagrammatic perspective view of the example bracket element shown in FIG. 1.
Figure 3:
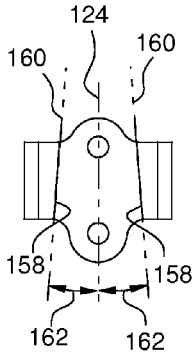
FIG. 3 is a diagrammatic rear view of the example bracket element shown in FIG. 1.
Figure 4:
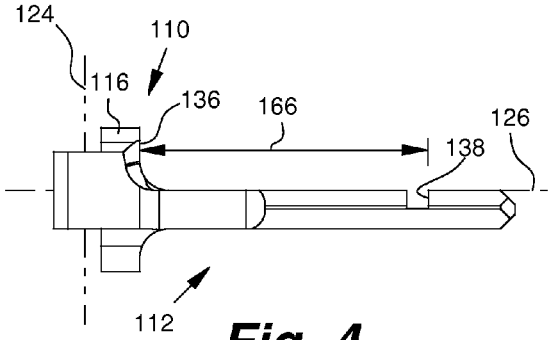
FIG. 4 is a diagrammatic side view of the example bracket element shown in FIG. 1.
Figure 5:
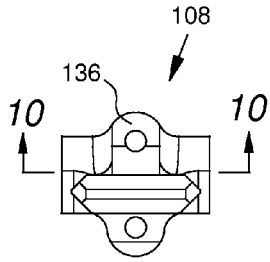
FIG. 5 is a diagrammatic front view of the example bracket element shown in FIG. 1.
Figure 10:
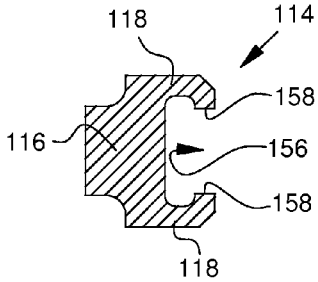
FIG. 10 is a diagrammatic cross-sectional view taken along line 10-10 in FIG. 5, showing one example of a generally C-shaped cross-section of a clamp member.
Figure 11:
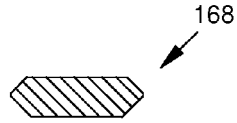
FIG. 11 is a diagrammatic cross-sectional view taken along line 11-11 in FIG. 7, illustrating one example of a rail portion cross-section which is bounded within the Mil-STD-1913 accessory mounting rail profile specifications.
Figure 13:
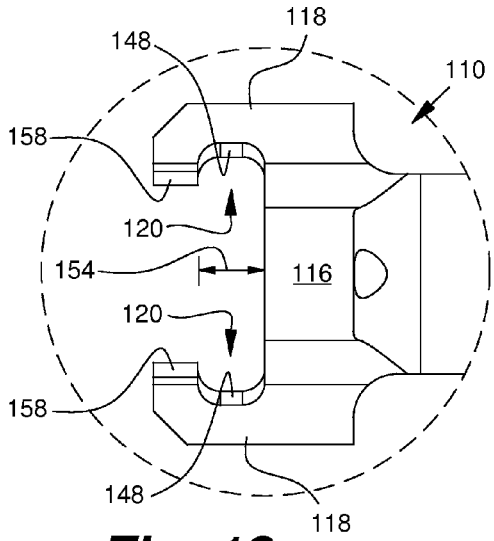
FIG. 13 is a diagrammatic magnified view of detail 13 in FIG. 7, illustrating one example of a channel with a lateral opening and mutually facing clamp lips.
Figure 14:
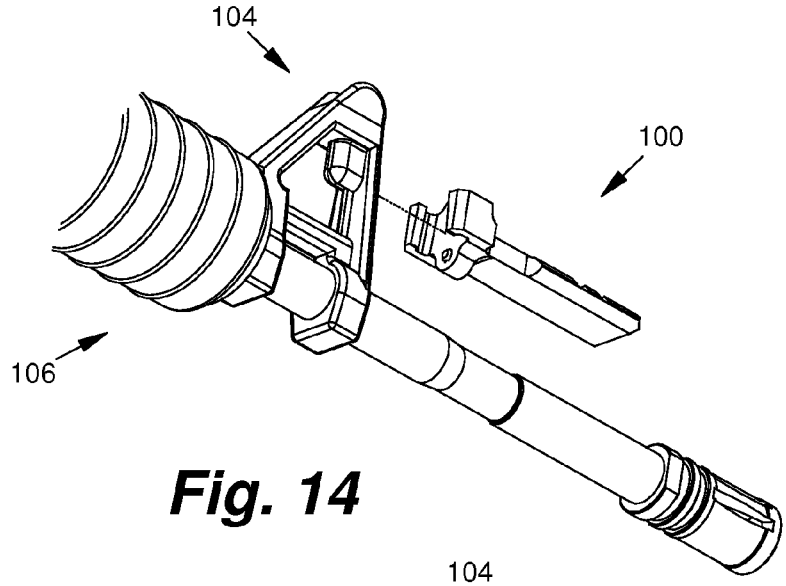
FIG. 14 is a diagrammatic perspective view of an initial step in a sequence for securing one example of a mounting system to a front sight base of a host weapon, wherein the clamp member is being brought into receiving engagement with the narrower upper portion of a front sight base.
Figure 15:
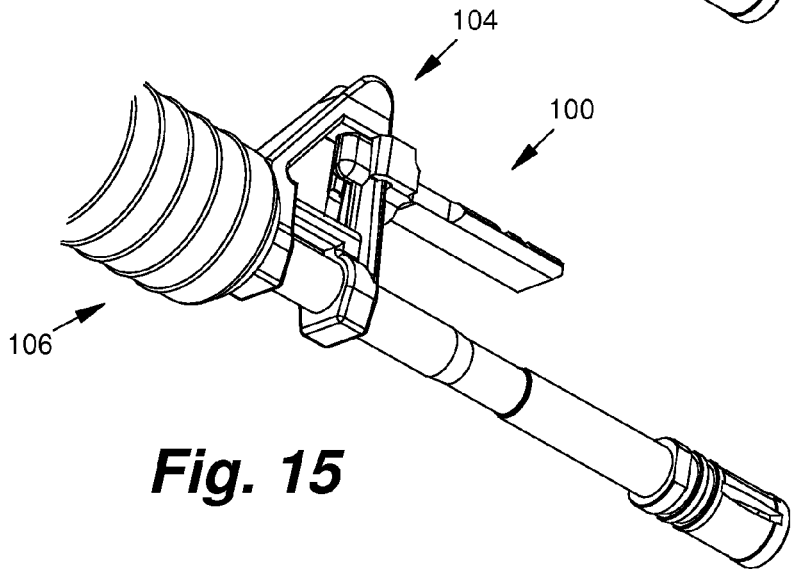
FIG. 15 is a diagrammatic perspective view of a further step in a sequence for securing one example osightf a mounting system to a front sight base of a host weapon, wherein the clamp member has been brought into receiving engagement with the narrower upper portion of a front sight base.
Figure 16:
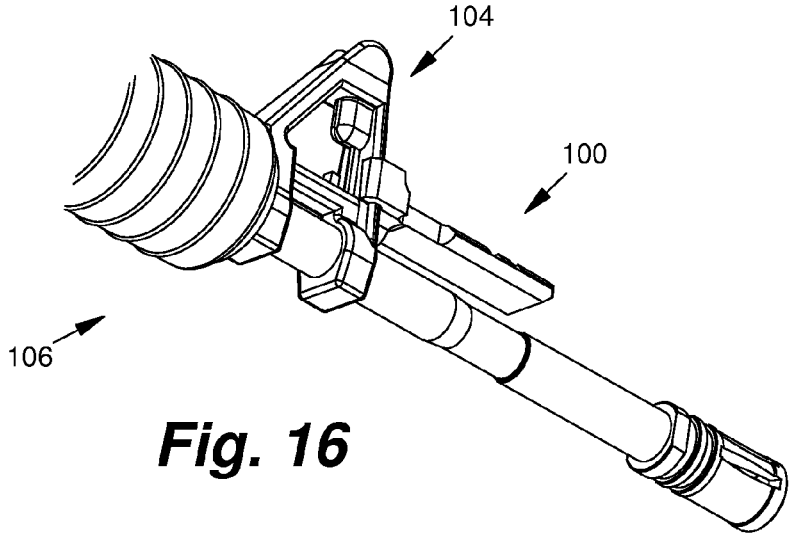
FIG. 16 is a diagrammatic perspective view of yet a further step in a sequence for securing one example of a mounting system to a front sight base of a host weapon, wherein the clamp member has been moved downward into receiving engagement with the broader lower portion of a front sight base, and where it can be secured by way of a clamping force.
Figure 36:
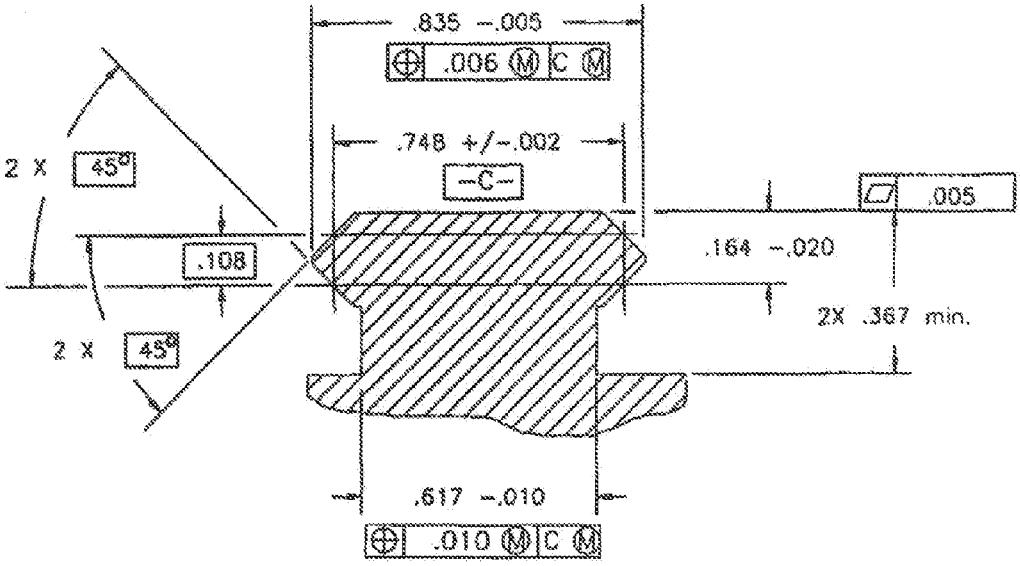
PRIOR ART Fig. 36
FIG. 36 is an accurate depiction of the Mil-STD-1913 accessory mounting rail profile specification.

Referring to FIGS. 2 and 4, the bracket element 108 may include a clamp member 110 and a plank member 112. Referring to FIGS. 10 and 13, the clamp member 110 may (as shown, for example, at 114) be defined by a base portion 116 disposed between two laterally opposed clamp arms 118 each having an inner groove 120. The cross-sectional shape 114 of the clamp member may at least partially define a channel 122 extending along a sight base axis 124. The plank member 112 may extend outwardly from the base portion 116 along an aim axis 126. The plank member may have a rail portion 128. Referring to FIG. 2, the rail portion 128 may have two laterally disposed rail edges 130 and at least one accessory engagement slot 132 extending laterally therebetween. The rail portion 128 may have a cross-section 168 bounded within the Mil-STD-1913 accessory mounting rail profile specifications (such specification shown, for example, in FIG. 36). As illustrated, for example, in FIG. 4, the aim axis 126 may be substantially perpendicular to the sight base axis 124.

Figure 17:
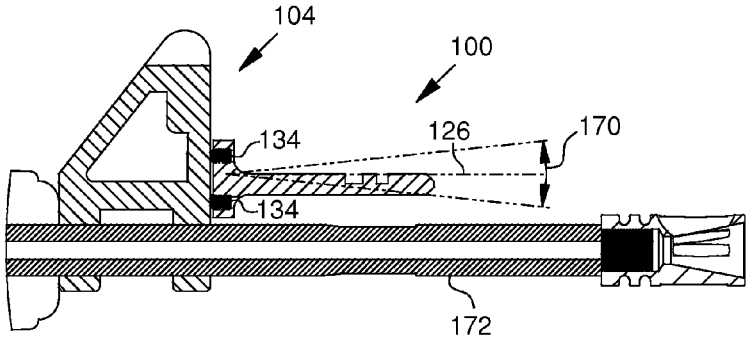
FIG. 17 is a diagrammatic cross-sectional view of a bracket element placed in receiving engagement with a front sight base of a host weapon, and the differential tightening of detent elements in the form of set screws is shown to allow adjustment to the pitch angle of the bracket element.
Figure 19:
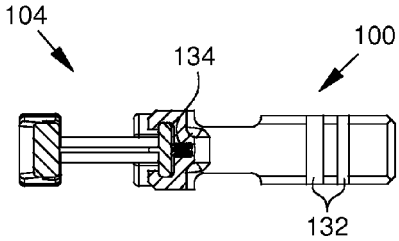
FIG. 19 is a diagrammatic cross-sectional view taken along line 19-19 in FIG. 18.

Referring to FIGS. 17 and 19, the at least one detent element 134 may be disposed in the base portion 116 for actuatable protrusion of at least a portion of the detent element 134 into the channel 122. Depending upon the particular embodiment, the detent element 134 may be, for example, a set screw (as shown, for example, in FIG. 17), a spring detent such as a ball detent, or other similar actuatable detent devices. Some preferred embodiments may comprise a first and a second detent element 134 arranged generally along the sight base axis 124 on opposite sides of the aim axis 126 and spaced therefrom. The plank member 112 may intersect the base portion 116 generally between the first and second detent elements 134.

Referring to FIG. 17, in attaching certain embodiments to the front sight base 104, wherein the embodiment includes two actuatable detent elements 134 (such as the set screws shown), the set screws may act as a locking cam. First, the installer may tighten the bottom screw, which will cause the clamp arms 118 grab onto the front sight base 104 and raise the aim axis 126 of the bracket element 108 out of general parallel alignment with the barrel 172. Once the bottom set screw 134 is snug, the installer may then tighten the top set screw 134 until the aim axis 126 of the bracket element 108 aligns with the barrel 172 in generally parallel fashion. The resulting leverage about the clamp lips 158 may greatly increase the force applied to the front sight base 104 by the bottom set screw 134 and the clamp lips 158, thereby rigidly securing the bracket element 108 to the front sight base 104.

Figure 6:
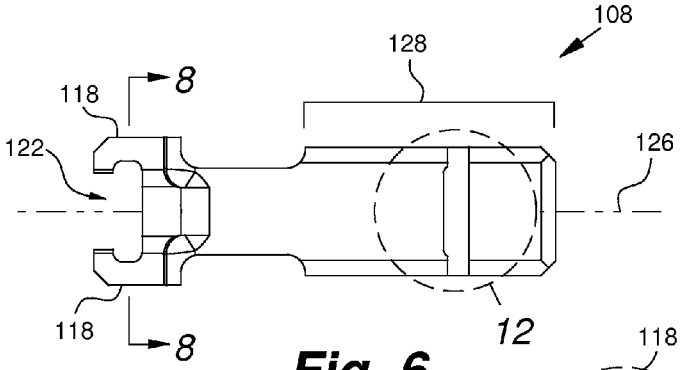
FIG. 6 is a diagrammatic top view of the example bracket element shown in FIG. 1.
Figure 7:
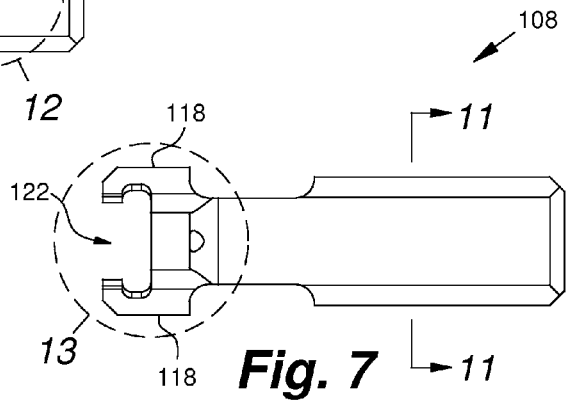
FIG. 7 is a diagrammatic bottom view of the example bracket element shown in FIG. 1.
Figure 12:
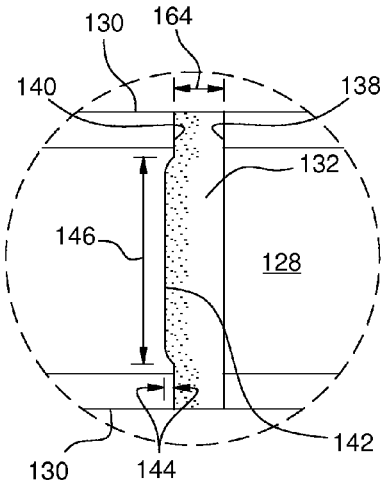
FIG. 12 is a diagrammatic magnified view of detail 12 in FIG. 6, illustrating one example of an accessory engagement slot with a proximal wall having a depression therein.

Referring to FIGS. 6 and 12 for illustration, in certain embodiments, the at least one accessory engagement slot 132 has a distal wall 138 and proximal wall 140. In at least one such engagement slot 132, the proximal wall 140 may have a depression portion 142 therein. In particular such embodiments, the distal wall 138 and the proximal wall 140 may be approximately 0.14 inches apart, the depression portion 142 may have a depression depth 144 of approximately between 0.025 and 0.35 inches and a depression width 146 of approximately between 0.55 and 0.65 inches.

Figure 8:
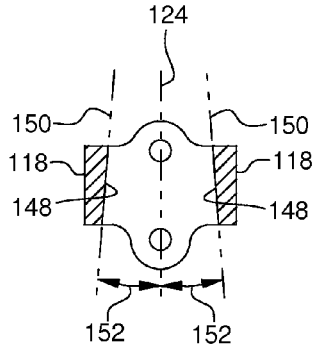
FIG. 8 is a diagrammatic cross-sectional view taken along line 8-8 in FIG. 6 in which each gripping surface is generally linear and terminates along a sloped gripping axis.
Figure 9:
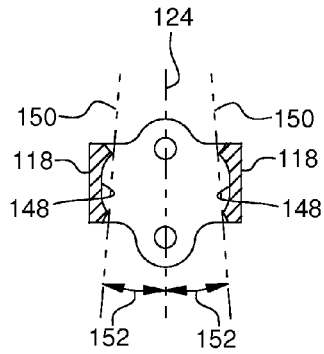
FIG. 9 is a diagrammatic cross-sectional view also taken along line 8-8 in FIG. 6 illustrating an alternative example in which each gripping surface is non-linear, but still terminates along a respective gripping axis.
Figure 20:
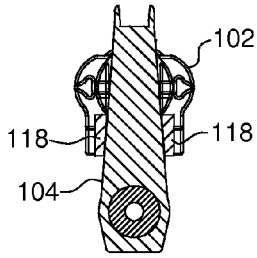
FIG. 20 is a diagrammatic cross-sectional view taken along line 20-20 in FIG. 18.

Referring to FIGS. 8 and 9 for illustration, in particular embodiments, each of the inner grooves 122 may have a gripping surface 148 which terminates along a gripping axis 150. The gripping axes 150 may be sloped at a gripping angle with respect to the sight base axis 124. FIGS. 8 and 9 depict two distinctive example variations on the design of the gripping surfaces 148. In some embodiments, the gripping angle 152 may be approximately between 4 and 5 degrees. As illustrated in FIG. 20, for example, in embodiments, the griping angle 152 is typically selected to additively closely match the lateral taper of the front sight base 104 of a particular host weapon 106. This feature helps secure the bracket element 108 to the front sight base 104 and prevent it from rocking or "walking" upwardly and out of securement with the front sight base 104 as a result of repeated handling and firing of the host weapon 106.

In certain embodiment, the channel 122 has a channel depth 154 oriented parallel to the aim axis 126. In examples of such an embodiment, the channel depth 154 may be, for example, approximately between 0.17 and 0.20 inches. The channel 122 of particular embodiments may have a lateral opening 156. The lateral opening 156 may be at least partially defined by mutually facing clamp lips 158 each terminating along a respective lip axis 160. The lip axes 160 may be sloped at a lip angle 162 with respect to the sight base axis 124. Depending upon the embodiment, the lip angle 162 may be, for example, approximately between 4 and 5 degrees. The lip angles 162 may be selected, for example, to additively closely match the lateral taper of the front sight base 104 (such lateral taper being illustrated, for example, in FIG. 20). Certain standard M16 front sight bases have a lateral taper of approximately 9 degrees.

Depending upon the particular embodiment, the bracket element 108 may be made substantially of aluminum, such as, for example, hard-anodized 6061 T6 aluminum. In other embodiment, the bracket element 108 may be made substantially of a reinforced polymer, examples of which may be referred to as a tactical polymer and may include glass filled nylon.

Figure 18:
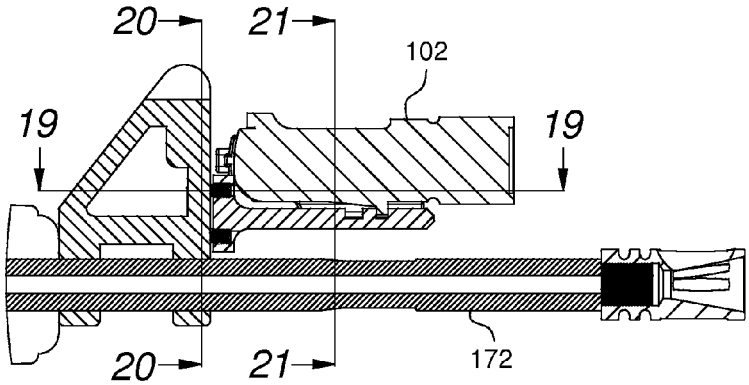
FIG. 18 is a diagrammatic cross-sectional view of one particular mounting system in accordance with the present invention, showing one example of an accessory element removably mounted to the bracket element and in releasable latching engagement with an accessory engagement slot.
Figure 21:
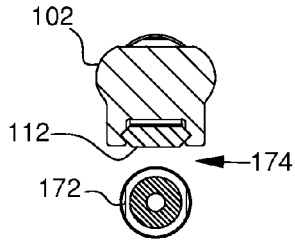
FIG. 21 is a diagrammatic cross-sectional view taken along line 21-21 in FIG. 18, illustrating the lack of direct contact between the bracket element and the barrel of the host weapon, a feature which may inhibit the transfer of heat from the barrel to the electronics of the accessory element, and may minimize the effect the accessory element or bracket element have on the barrel harmonics.

In particular embodiments, such as the one shown throughout the several Figures, the plank member 112 is substantially flat planar. Referring to FIGS. 18 and 21 for illustration, this feature may allow the plank member 112 to substantially shield the respective accessory element 102 from the heat radiating or convecting off of the barrel 172. Embodiments of a system 100 may comprise alternative or additional materials which further facilitate such thermal shielding. Further, as illustrated for example in FIG. 21, the system 100 provides a gap 174 between the plank member 112 and the barrel, thereby substantially preventing the conduction of heat from the barrel 172 to the respective accessory element 102 and substantially preventing the accessory element 102 and the bracket element 108 from interfering with the harmonics of the barrel 172.

Referring to FIGS. 4 and 18 for illustration, in certain embodiments, the base portion 116 may have an accessory detent face 136 disposed oppositely of the channel 122. In such embodiments, an accessory engagement slot 132 may have a distal wall 138 disposed, for example, approximately between 1.865 and 1.885 inches from the accessory detent face.

Figure 37:
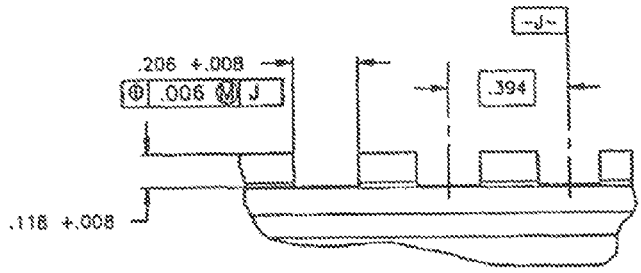
PRIOR ART Fig. 37
FIG. 37 is an accurate depiction of the Mil-STD-1913 recoil groove specification.

In particular embodiments, the rail portion 128 may have a multiplicity of accessory engagement slots 132. In such embodiments, accessory engagement slots 132 may have respective slot widths 164 of, for example, approximately between 0.14 and 0.21 inches. In certain such embodiments, the spacing and slot widths of the accessory engagement slots 132 may be consistent with Mil-STD-1913 recoil groove specifications (such specifications shown, for example, at FIG. 37).

Figure 22:
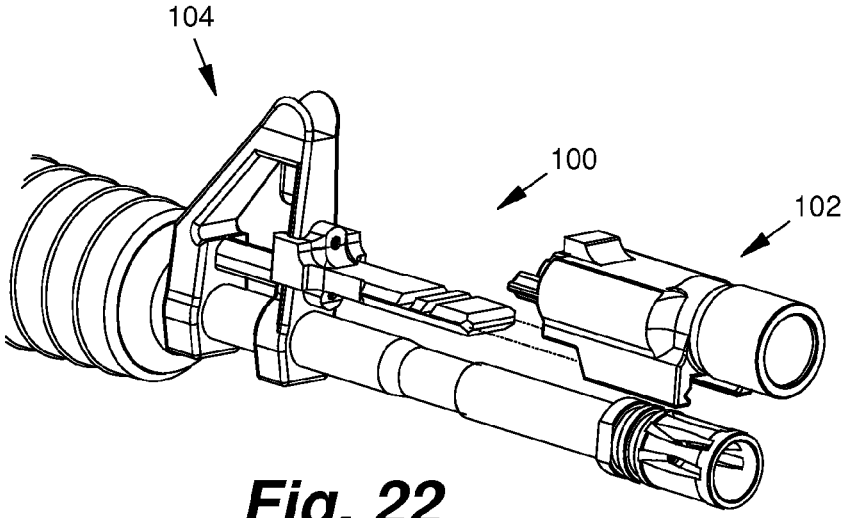
FIG. 22 is a diagrammatic perspective view of one example of an accessory element, a conventional LED weapon light, being removably mounted to the bracket element by way of slidable engagement with the rail portion.
Figure 23:
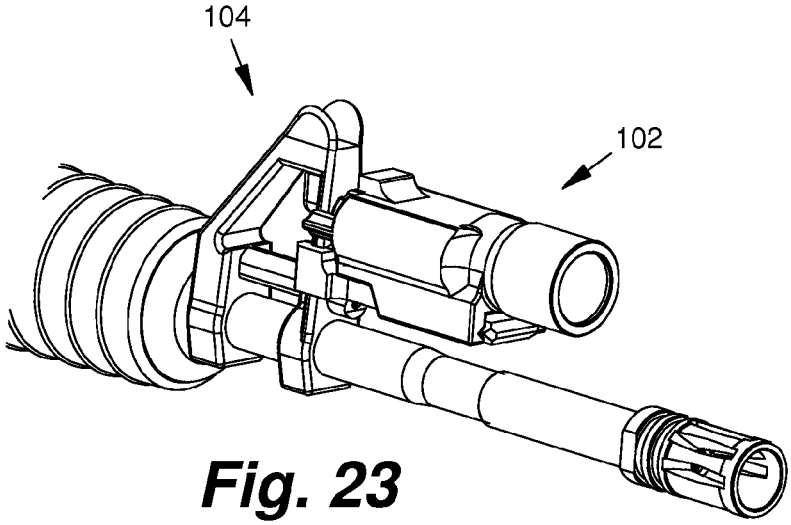
FIG. 23 is a diagrammatic perspective view showing the system of FIG. 22 in which the accessory element is fully mounted in the 12 o'clock position on the host weapon without contacting the barrel or interfering with the sight picture.
Figure 24:
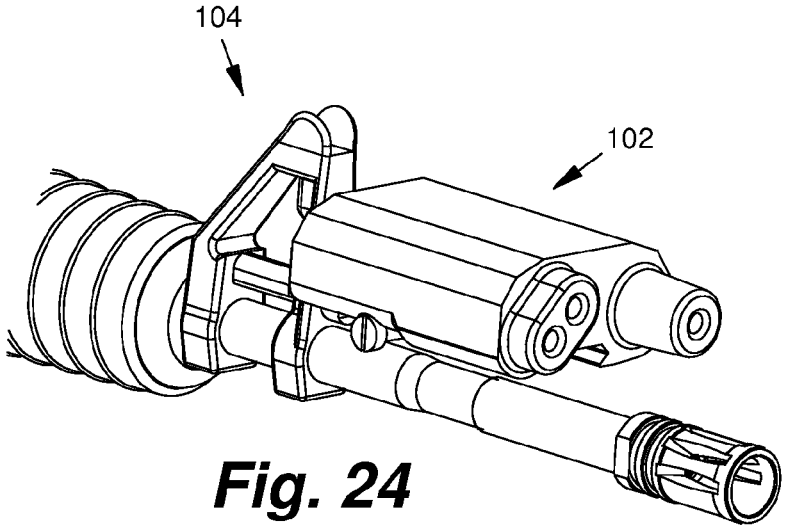
FIG. 24 is a diagrammatic perspective view showing the system similar to that shown in FIG. 23, but in which the accessory element is a conventional laser/illuminator fully mounted in the 12 o'clock position on the host weapon without contacting the barrel or interfering with the sight picture.
Figure 25:
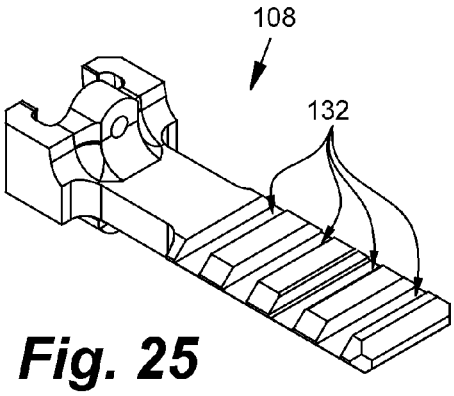
FIG. 25 is a diagrammatic perspective view showing a further example of a bracket element, in which the rail member has a multiplicity of accessory engagement slots.
Figure 26:
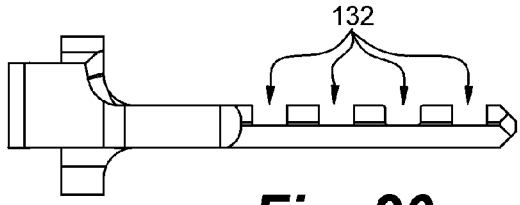
FIG. 26 is a diagrammatic side view of the embodiment shown in FIG. 25.

Referring to FIG. 22 for illustration, in certain embodiments of the system 100, the bracket element 108 may be removably secured to the front sight base 104 of the host weapon 106 by way of the clamp member 110 and a clamping force provided by at least one detent element 134. Referring to FIGS. 23 and 24 for illustration, in such embodiments, the accessory element 102 may be removably mounted to the bracket element 108 by way of slidable engagement with the rail portion 128 and releasable latching engagement between the accessory element 102 and an accessory engagement slot 132.

In particular embodiments, the clamp member 110 may be adapted to be removably rigidly secured directly to the front sight base 104 of the host weapon 106 such that the base portion 116 is positioned outward from the front sight base 104 in a direction generally toward the muzzle of the host weapon 106. The plank member 112 may extend outwardly from the base portion 116 along an aim axis 126 being approximately parallel with the barrel 172 of the host weapon 106. The rail portion 128 may have two laterally disposed rail edges 130 adapted to be slidably received by an accessory element 102. At least one accessory engagement slot 132 may be provided for releasable latching engagement by the accessory element 102. In such embodiments, the clamp member 110 may be removably rigidly secured to the front sight base 104 by way of a clamping force provided by a spring, a cam, threaded element, or the like.

Figure 27:
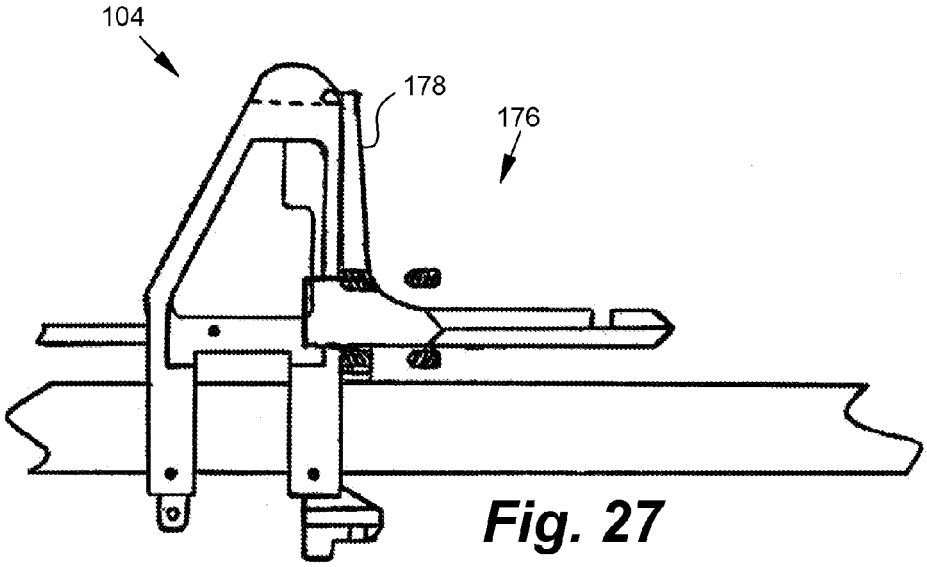
FIG. 27 is a diagrammatic partial cross-sectional view of a further embodiment in accordance with the present invention, in which the base portion includes a vertically extending stabilizer member.
Figure 28:
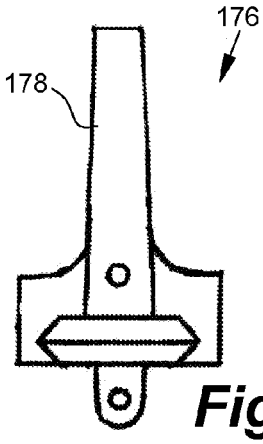
FIG. 28 is a diagrammatic front view of the embodiment shown in FIG. 27.
Figure 29:
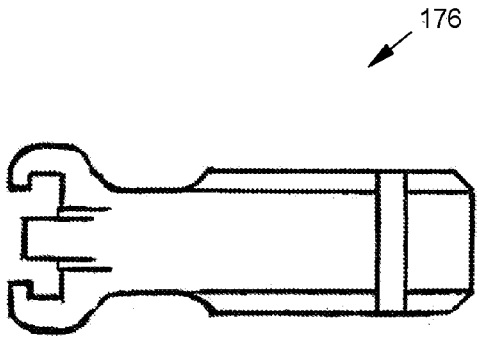
FIG. 29 is a diagrammatic top view of the embodiment shown in FIG. 27.
Figure 30:
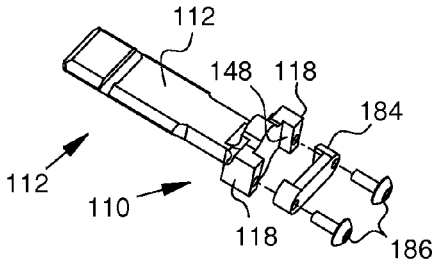
FIG. 30 is a diagrammatic perspective view of a further embodiment in accordance with the present invention.
Figure 31:
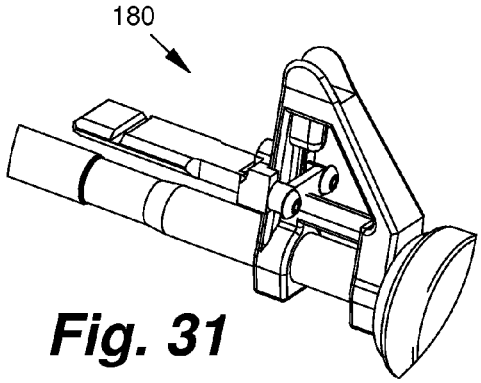
FIG. 31 is a diagrammatic perspective view of the embodiment shown in FIG. 30, but in which the bracket element is removably secured to the front sight base of a host weapon.
Figure 32:
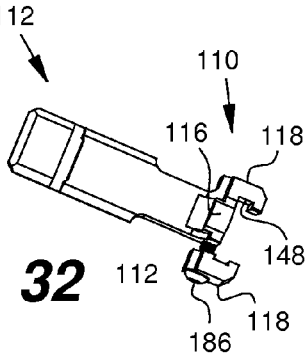
FIG. 32 is a diagrammatic perspective view of another embodiment.
Figure 33:
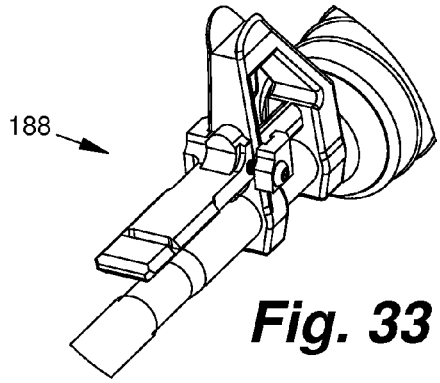
FIG. 33 is a diagrammatic perspective view of the embodiment shown in FIG. 32, but in which the bracket element is in the process of being removably secured to the front sight base of a host weapon.
Figure 34:
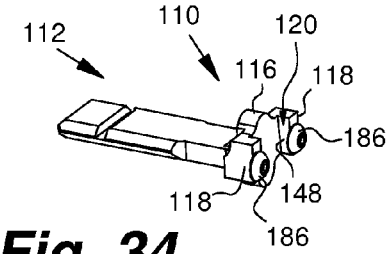
FIG. 34 is a diagrammatic perspective view of yet another embodiment.
Figure 35:
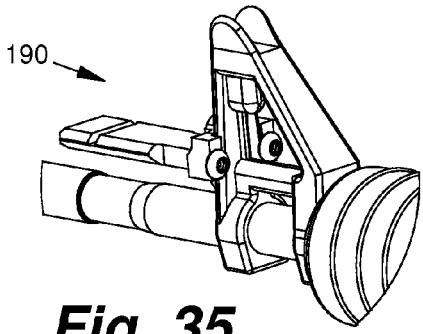
FIG. 35 is a diagrammatic perspective view of the embodiment shown in FIG. 34, but in which the bracket element is removably secured to the front sight base of a host weapon.

Various further potential embodiments are depicted in FIGS. 27-35. For example, FIGS. 27-29 depict an alternate embodiment of a system 176 in which the base portion 116 includes a vertically-extending stabilizer element 178 to help in limiting the rotation of bracket element with respect to the front sight base. FIGS. 30 and 31 depict an alternate embodiment of a system 180 in which the clamping force is provided by two clamp screws 186 and a strap element 184. FIGS. 32 and 33 depict an alternate embodiment of a system 188 in which the clamping force is provided by way of a laterally-extending clamp screw 186 capable of tightening one of the clamp arms 118 with respect to the remainder of the base portion 116. FIGS. 34 and 35 depict an alternate embodiment of a system 190 in which the clamping force is provided by two clamp screws 186, which also act as clamp lips 158 of the base portion 116.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A weapon accessory mounting system for releasably mounting an accessory element directly onto the front sight base of a host weapon without requiring permanent modification of the host weapon, the system comprising:

a bracket element including a clamp member and a plank member, the clamp member defined by a base portion disposed between two laterally opposed clamp arms each having an inner groove, the cross-sectional shape of the clamp member at least partially defining a channel extending along a sight base axis, the plank member extending outwardly from the base portion along an aim axis, the plank member having a rail portion, the rail portion having two laterally disposed rail edges and at least one accessory engagement slot extending laterally therebetween, the aim axis being substantially perpendicular to the sight base axis; and a first and second detent element disposed in the base portion for protrusion of at least a portion of each detent element into the channel, wherein the plank member intersects the base portion between the first and second detent elements and at least one of the first and second detent elements is actuatable.

2. A weapon accessory mounting system as defined in claim 1 in which the at least one accessory engagement slot has a distal wall and proximal wall, the proximal wall having a depression portion therein.

3. A weapon accessory mounting system as defined in claim 2 in which the distal wall and the proximal wall are approximately 0.14 inches apart, the depression portion having a depression depth of approximately between 0.025 and 0.35 inches and a depression width of approximately between 0.55 and 0.65 inches.

4. A weapon accessory mounting system as defined in claim 1 in which the detent element is a set screw.

5. A weapon accessory mounting system as defined in claim 1 in which the detent element is a spring detent.

6. A weapon accessory mounting system as defined in claim 1 in which the first and second detent elements are arranged generally along the sight base axis on opposite sides of the aim axis and spaced therefrom.

7. A weapon accessory mounting system as defined in claim 1 in which each of the inner grooves has a gripping surface which terminates along a gripping axis, the gripping axes being sloped at a gripping angle with respect to the sight base axis.

8. A weapon accessory mounting system as defined in claim 7 in which the gripping angle is approximately between 4 and 5 degrees.

9. A weapon accessory mounting system as defined in claim 1 in which the channel has a channel depth oriented parallel to the aim axis, the channel depth being approximately between 0.17 and 0.20 inches.

10. A weapon accessory mounting system as defined in claim 1 in which the channel has a lateral opening, the lateral opening being at least partially defined by mutually facing clamp lips each terminating along a respective lip axis, the lip axes being sloped at a lip angle with respect to the sight base axis.

11. A weapon accessory mounting system as defined in claim 10 in which the lip angle is approximately between 4 and 5 degrees.

12. A weapon accessory mounting system as defined in claim 1 in which the bracket element is made substantially of aluminum.

13. A weapon accessory mounting system as defined in claim 1 in which the bracket element is made substantially of a reinforced polymer.

14. A weapon accessory mounting system as defined in claim 1 in which the plank member is substantially flat planar.

15. A weapon accessory mounting system as defined in claim 1 in which the base portion has an accessory detent face disposed oppositely of the channel and one of the at least one accessory engagement slot has a distal wall disposed approximately between 1.865 and 1.885 inches from the accessory detent face.

16. A weapon accessory mounting system as defined in claim 1 in which the rail portion has a multiplicity of said accessory engagement slots, each accessory engagement slot having a respective slot width of approximately between 0.14 and 0.21 inches.

17. A weapon accessory mounting system as defined in claim 1 in which the rail portion has a cross-section bounded within the Mil-STD-1913 accessory mounting rail profile specifications.

18. A weapon accessory mounting system as defined in claim 1 in which the bracket element is removably secured to the front sight base of the host weapon by way of the clamp member and a clamping force provided by the at least one detent element.

19. A weapon accessory mounting system as defined in claim 18 in which the accessory element is removably mounted to the bracket element by way of slidable engagement with the rail portion and releasable latching engagement between the accessory element and one of the at least one accessory engagement slot.

20. A weapon accessory mounting system for releasably mounting an accessory element directly onto the front sight base of a host weapon without requiring permanent modification of the host weapon, the system comprising:

a bracket element including a clamp member and a plank member, the clamp member defined by a base portion disposed between two laterally opposed clamp arms each having an inner groove, the cross-sectional shape of the clamp member at least partially defining a channel extending along a sight base axis, each of the inner grooves having a gripping surface which terminates along a gripping axis, the gripping axes being sloped with respect to the sight base axis, the channel having a lateral opening at least partially defined by mutually facing clamp lips each terminating along a respective lip axis, the lip axes being sloped with respect to the sight base axis, the plank member extending outwardly from the base portion along an aim axis, the plank member having a rail portion, the rail portion having a cross-section bounded within the Mil-STD-1913 accessory mounting rail profile specifications and having and at least one accessory engagement slot extending substantially perpendicularly to the aim axis, the aim axis being substantially perpendicular to the sight base axis; and a first and second detent element disposed in the base portion for actuatable protrusion of at least a portion of each detent element into the channel, the plank member intersecting the base portion between the first and second detent elements.

21. A weapon accessory mounting system for releasably mounting an accessory element directly onto the front sight base of a host weapon without requiring permanent modification of the host weapon, the system comprising:

a bracket element including a clamp member and a plank member, the clamp member defined by a base portion disposed between two laterally opposed clamp arms each having an inner groove, the cross-sectional shape of the clamp member at least partially defining a channel extending along a sight base axis, each of the inner grooves having a gripping surface which terminates along a gripping axis, the gripping axes being sloped with respect to the sight base axis at a gripping angle of approximately between 4 and 5 degrees, the channel having a lateral opening at least partially defined by mutually facing clamp lips each terminating along a respective lip axis, the lip axes being sloped with respect to the sight base axis at a lip angle of approximately between 4 and 5 degrees, the plank member extending outwardly from the base portion along an aim axis, the plank member being substantially flat planar and having a rail portion, the rail portion having two laterally disposed rail edges and a multiplicity of accessory engagement slots extending laterally therebetween, the aim axis being substantially perpendicular to the sight base axis; and first and second detent elements disposed in the base portion for actuatable protrusion of at least a portion of each detent element into the channel, the plank member intersecting the base portion between the first and second detent elements, at least one of the first and second detent elements being threadably actuatable with respect to the bracket element.

22. A weapon accessory mounting system for releasably mounting an accessory element directly onto the front sight base of a host weapon without requiring permanent modification of the host weapon, the system comprising:

a bracket element including a clamp member and a plank member, the clamp member defined by a base portion disposed between two laterally opposed clamp arms each having an inner groove, the cross-sectional shape of the clamp member at least partially defining a channel extending along a sight base axis, each of the inner grooves having a gripping surface which terminates along a gripping axis, the gripping axes being sloped at a gripping angle with respect to the sight base axis, the gripping angle being approximately between 4 and 5 degrees, the channel having a lateral opening at least partially defined by mutually facing clamp lips each terminating along a respective lip axis, the lip axes being sloped at a lip angle with respect to the sight base axis, the lip angle being approximately between 4 and 5 degrees, the plank member extending outwardly from the base portion along an aim axis, the plank member having a rail portion, the rail portion having two laterally disposed rail edges and at least one accessory engagement slot extending laterally therebetween, the aim axis being substantially perpendicular to the sight base axis; and at least one detent element disposed in the base portion for actuatable protrusion of at least a portion of the detent element into the channel.

* * * * *